United States Patent [19]

Järund

[11] Patent Number: 4,512,472

[45] Date of Patent: Apr. 23, 1985

[54] SUCTION TUBE PACKAGE

[75] Inventor: Erik Järund, Fjällbacka, Sweden

[73] Assignee: Tetra Pak International AB, Lund, Sweden

[21] Appl. No.: 542,712

[22] Filed: Oct. 17, 1983

[30] Foreign Application Priority Data

Oct. 21, 1982 [SE] Sweden ..... 8205977

[51] Int. Cl.[3] ..... B65D 77/28; B65D 85/08

[52] U.S. Cl. ..... 206/443; 206/217; 206/820; 229/7 S; 215/1 A

[58] Field of Search ..... 206/217, 813, 820, 443; 229/7 S; 215/1 A

[56] References Cited

U.S. PATENT DOCUMENTS

| | | | |
|---|---|---|---|
| 1,185,538 | 5/1916 | Rand, Jr. | 206/820 |
| 1,764,569 | 6/1930 | Knee | 206/813 |
| 1,830,571 | 11/1931 | Süllwald | 206/820 |
| 2,268,379 | 12/1941 | Bird et al. | 206/820 |
| 3,416,651 | 12/1968 | Järund | 206/820 |
| 4,076,122 | 2/1978 | Hall | 206/813 |
| 4,363,401 | 12/1982 | Saragian | 206/820 |
| 4,398,634 | 8/1983 | McClosky | 206/820 |

FOREIGN PATENT DOCUMENTS

| | | | |
|---|---|---|---|
| 33302 | 8/1981 | European Pat. Off. | 206/217 |
| 2828881 | 1/1980 | Fed. Rep. of Germany | 206/217 |
| 2847168 | 5/1980 | Fed. Rep. of Germany | 206/443 |

*Primary Examiner*—William T. Dixson, Jr.
*Assistant Examiner*—Brenda J. Ehrhardt
*Attorney, Agent, or Firm*—Burns, Doane, Swecker & Mathis

[57] ABSTRACT

Suction tube packages comprising suction tubes arranged in succession, which are placed between two weblike plastic strips sealed to one another, are used for the application of suction tubes to packing containers for e.g. juice or milk. The weblike suction tube packages are provided with transverse cuts between each individual suction tube envelope which facilitate the separation of individual envelopes on application of the suction tube envelopes to the packing container, but increase the risk of unintentional detachment of envelopes from the suction tube package. This risk can be appreciably reduced if the suction tube package is provided between, or on the outside of, the two long strips sealed to one another with two substantially parallel tapes (11,12) situated at some distance from one another. The tapes (11,12) absorb the stresses the suction tube strip is subjected to in longitudinal direction and thus prevent them from causing a lengthening of the cuts present in the suction tube package as a result of which individual suction tube envelopes could be separated unintentionally or the cuts could extend into and damage the tight suction tube envelopes.

6 Claims, 2 Drawing Figures

SUCTION TUBE PACKAGE

The present invention relates to a suction tube package comprising flexible strips between which suction tubes are placed transversely, these strips being sealed to one another around the suction tube and partly cut through between the seals.

Suction packages which consist of suction tubes wrapped in protective envelopes and joined to one another so as to form a "rope-ladderlike" strip are used to facilitate mechanical handling and application of the wrapped suction tubes to packing containers. The weblike coherent suction tubes, packed in individual envelopes, are separated from the strip in connection with the application to the individual packing container. To facilitate the separation, the suction tube strip is provided between the individual packing envelopes with transverse cuts which partly separate the envelopes from one another so that they are connected only in narrow zones acting as links or hinges. To avoid the generation of wastage which might make the manufacture of suction tube strips more difficult, the cuts are carried out with the help of simple, narrow knives with the result, however, that the material at the end of the cuts tends to break during handling of the suction tube strip so that under adverse circumstances it may be divided up into individual suction tube packages during handling before or in the suction tube applicator machine. It has been tried to overcome this disadvantage by giving the cut ends the form of a "hollow moulding" which, however, leads to the generation of wastage which has to be taken care of during the manufacture of the suction tube strip and thus prevents high processing rates and leads to undesirable stops in production.

It is the object of the present invention to provide a weblike suction tube package which can be used in known types of suction tube applicators and which has the known "rope-ladderlike" basic form but which is not subject to the aforementioned disadvantages.

It is a further object of the present invention to provide a suction tube package consisting of weblike coherent suction tubes which are partly separated from one another by transverse cuts between suction tube envelopes, this suction tube package being designed so, however, that it is ensured that the cuts do not extend farther and damage the individual suction pipe envelopes or bring about an undesirable division of the suction tube package into individual envelopes.

These and other objects have been achieved in accordance with the invention in that flexible strips comprising a suction tube package between which the suction tubes are placed transversely, these strips being sealed to one another around the suction tubes and partly cut through between the seals, have been given the characteristic that two parallel tapes of a material that can be sealed to the strips extend in longitudinal direction of the strips at some distance from one another parallel with the longitudinal edges of the strips.

Preferred embodiments of the suction tube package in accordance with the invention have been given moreover the characteristics which are evident from the enclosed subsidiary claims.

By providing the suction tube package with two longitudinal material tapes which extend in the regions wherein the individual envelopes are connected, the risk of any unintentional disintegration of the suction tube package is considerably reduced, since the tapes take up the forces resulting from tensile stresses in the suction tube package and relieve the unbroken zones between the individual suction tube envelopes so that the cuts do not proceed any further. As the cuts do not in any manner extend into or weaken the strips, the risk of a rupture on the tapes is very small. The tapes can be strengthened further by the selection of a suitable material and by making the tapes e.g. from a material oriented in longitudinal direction.

A preferred embodiment of the suction tube package in accordance with the invention will now be described in detail with special reference to the enclosed schematic drawing which only shows the details essential for an understanding of the invention.

Figure 1:
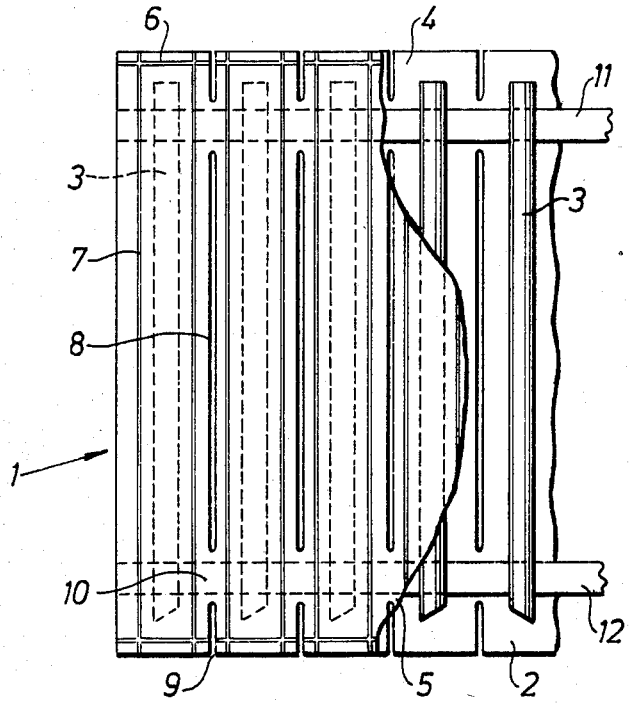
FIG. 1 shows part of a weblike suction tube package in accordance with the invention, a part of the package having been removed for the sake of clarity.

The weblike suction tube package 1 shown in FIG. 1 comprises a number of suction tube envelopes 2 coherent in succession, each of which comprises a suction tube 3.

The suction tube package, more particularly, comprises two flexible strips 4,5 between which suction tubes 3 are placed transversely with equal spaces between them. The width of the strips 4,5 is a little greater than the length of the suction tube 3 which means that the edges of the strips are some way outside the ends of the suction tube 3. The edge zones of the strips 4,5 are sealed in a liquidtight and airtight manner to one another with the help of longitudinal seals 6. By means of transverse seals 7 on either side of each suction tube 3, the closed pockets or envelopes 2 are formed wherein each individual suction tube 3 is located and protected from contamination, moisture of other external influences.

Figure 2:
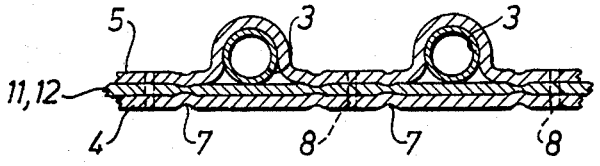
FIG. 2 shows on a larger scale a section through a part of a suction tube package in accordance with the invention, the thickness of the strips and of the tapes included having been considerably exaggerated.

Between each suction tube envelope 2 the strips 4,5 joined to one another in the said seals 6,7 are provided with transverse cuts. More particularly, between each pair of mutually adjoining suction tube envelopes a centrally located, transverse main cut 8 and two edge cuts 9 located in its prolongation are present. The edge cuts 9 extend from the longitudinal edges of the strips 4,5 and some way inwards between the suction tubes, whilst the main cuts 8 extend in line between the edge cuts 9, but terminate at some distance from them, so that two parallel rows of unbroken zones or links 10 are produced. In these unbroken zones or links 10 extend two longitudinal tapes 11,12 which preferably are situated between the two strips 4,5 and are sealed to the same in transverse seals 7 which thus seal together the strips 4,5 as well as the tapes 11,12. Hence the tapes 11,12 are unaffected by the cuts 8,9 and therefore serve as a reinforcement which takes up tensile stresses in the weblike suction tube packages and prevents these stresses from deforming or lengthening the cuts 8,9 which could result in their converging and causing undesirable separation of individual suction tube envelopes from the suction tube package or extending into the seal 7 and damaging the tightness of the individual envelopes. The tapes 11,12 can be placed either between the two strips 4,5, which generally is to be preferred, or else on the outside of the one strip 4 which, as can be seen from FIG. 2, is substantially plane, since the irregularities caused by the suction tubes 3 are concentrated on the other side of the suction tube package.

When the suction tube envelopes in connection with their application to individual packing containers are to be separated from the weblike suction tube package, two knives are used which cut off the tapes 11,12 and the unbroken zones of the strips 4,5 acting as links 10 at the same time as the suction tube envelope 2 is guided, and applied in the desired position, to the packing container. Owing to the presence of the cuts 8,9 the cutting off is facilitated at the same time as the individual, separated suction tube envelope 2 is given a neat appearance with straight cut edges, which had not been possible in previous suction tube envelopes, where it had been necessary because of the risk of breaks in the material to provide the same with "hollow mouldings" in the form of round perforations at the ends of the cuts 8,9 facing one another.

The reinforcing effect obtained thanks to the two tapes 11,12 can be enhanced even further by manufacturing the tapes from a plastic material oriented in longitudinal direction of the tape. It has been found that a particularly advantageous embodiment is obtained if the tapes 11,12 are manufactured from a laminated material which comprises a central layer of higher melting temperature than the outside layers or outside layer of a seal-promoting material, e.g. a so-called sealing varnish or any type of plastics which can be sealed to the plastic material of the strips. In this manner a reduction of the strength of the tapes 11,12 through the effect of heat when carrying out the transverse seals 7 is prevented. When the two strips 4,5 are manufactured from polyethylene, the tapes 11,12 appropriately comprise a central layer of polypropylene which is covered on both sides with polyethylene. In this way good adhesion between the tapes 11,12 and the strips 4,5 in the transverse seals is ensured at the same time as the central polypropylene layer cannot be affected but retains its full strength.

The weblike suction tube package in accordance with the invention has proved in practical application to have optimum properties insofar as strength as well as design and appearance are concerned. The necessary strength is obtained with the help of the tapes 11,12 at the same time as the retention of the cuts 8,9 from earlier designs of the suction tube strip facilitates the handling and the separation of the individual suction tube envelopes. The absence of hollow mouldings or similar crackpreventing arrangements at the ends of the cuts has the effect that the individual suction tube envelopes after they have been detached from the web-shaped suction tube package are given a symmetrical, substantially rectangular appearance without tattered or profiled edges which is an advantage in respect of their appearance.

I claim:

1. A suction tube package comprising a pair of flexible strips between which a plurality of suction tubes are placed transversely, said strips being sealed to one another on all sides of the suction tubes and provided with cut portions between the seals, wherein the strips have a width greater than a length of the suction tubes and edges of the strips protrude beyond the length of the tubes; said seals comprising longitudinal seals which seal longitudinal edge zones of said strips and transverse seals extending along the width of the strips on either side of each Suction tube; said longitudinal and said transverse seals defining closed pockets for each suction tube; said cuts provided parallel to said transverse seals and said closed pockets; a plurality of edge cuts provided in said edge zones transverse to said longitudinal seals; two parallel tapes of a material sealed between the strips extending in a longitudinal direction of the strips at some distance from one another parallel with the longitudinal edges; said tapes extending longitudinally between said cut portions and said edge cuts so as to provide uncut length of said two parallel tapes; said two parallel tapes sealed to said traverse seals so as to prevent tensile stresses from deforming said cut portions and said edge cuts.

2. A suction tube package in accordance with claim 1. characterized in that further cuts (8) extend in line with the other cuts (9) substantially from the one tape (11) to the other tape (12).

3. A suction tube package in accordance with claim 1, wherein the tapes are manufactured from a laminated material which comprises a central layer of higher melting temperature than outer layers.

4. A suction tube package in accordance with claim 3, characterized in that the tapes (11,12) comprise a central layer of polypropylene which is covered on both sides with polyethylene.

5. A suction tube package in accordance with claim 4, wherein the tapes comprise one or more layers of plastic material oriented in the longitudinal direction of the tape.

6. A suction tube package in accordance with claim 1, wherein the seal between the strips serves at the same time as a seal for the tapes.

* * * * *